US006441705B1

(12) United States Patent
Costa et al.

(10) Patent No.: US 6,441,705 B1
(45) Date of Patent: Aug. 27, 2002

(54) TEMPERATURE SELF-COMPENSATING DECOUPLING FILTER FOR HIGH FREQUENCY TRANSCEIVERS

(75) Inventors: Mario Costa, Como; Roberto Ravanelli, Milan, both of (IT)

(73) Assignee: Siemens Information and Communication Networks S.p.A., Milan (IT)

( * ) Notice: Subject to any disclaimer, the term of this patent is extended or adjusted under 35 U.S.C. 154(b) by 0 days.

(21) Appl. No.: 09/830,277

(22) PCT Filed: Nov. 19, 1999

(86) PCT No.: PCT/EP99/09119

§ 371 (c)(1),
(2), (4) Date: May 30, 2001

(87) PCT Pub. No.: WO00/31866

PCT Pub. Date: Jun. 2, 2000

(30) Foreign Application Priority Data

Nov. 25, 1998 (IT) ..... MI98A2551

(51) Int. Cl.[7] ..... H01P 7/06
(52) U.S. Cl. ..... 333/229; 333/231; 333/232
(58) Field of Search ..... 333/209, 229, 333/206, 231, 232

(56) References Cited

U.S. PATENT DOCUMENTS

| | | | | |
|---|---|---|---|---|
| 2,998,582 A | | 8/1961 | Riblet | 333/229 |
| 3,160,825 A | | 12/1964 | Derr | 330/49 |
| 3,733,567 A | * | 5/1973 | Johnson | 333/234 |
| 4,035,749 A | | 7/1977 | Slocum et al. | 333/232 |
| 4,216,448 A | * | 8/1980 | Kasuga et al. | 333/203 |
| 4,360,793 A | * | 11/1982 | Rhodes et al. | 333/212 |
| 5,739,733 A | * | 4/1998 | Cameron | 333/202 |

FOREIGN PATENT DOCUMENTS

| | | | |
|---|---|---|---|
| DE | A13935785 | 5/1991 | H01P/7/06 |
| EP | A1274859 | 7/1988 | H01P/1/213 |

* cited by examiner

*Primary Examiner*—Robert Pascal
*Assistant Examiner*—Dean Takaoka

(57) ABSTRACT

The present invention relates to a duplexer set up by two decoupling filters for high frequency transceivers of the temperature self-compensating type and implemented by means of a pair of mechanic bodies (2), each one of which including a plurality of resonance cavities (3). Inside of the cavity (3) of the superior body (2) of the duplexer, a corresponding adjustment disc (7) is lodged in a removable and coaxial way which is provided with a supporting stem (8) coming out of a passage hole (12) obtained on the summit of the cavity (3). The bodies (2) are bound between them, so that the cavities of one or the other turn out to be coaxially facing each other. The passage hole (12) of the filter according to the invention is threaded. Moreover at each filter at least one bush (9) is associated having one portion (11) engaged in the hole (12) and inside of which the stem (8) of the disc (7) is housed.

5 Claims, 3 Drawing Sheets

TEMPERATURE SELF-COMPENSATING DECOUPLING FILTER FOR HIGH FREQUENCY TRANSCEIVERS

TECHNICAL FIELD

The present invention relates to a temperature self-compensating decoupling filter for high frequency transceivers.

More precisely the invention relates to a duplexer of the aforesaid type and it comprises a pair of filters with a specular shape, each one of which comprises a plurality of resonance cavities inside of which a corresponding adjustment disc is lodged in a removable and coaxial way provided with a stem coming out of a passage hole realised at the bottom of the cavity, whereby each filter is mechanically realised by means of an assemblage of two bodies (an upper and a lower one), so that the cavities of one or the other turn out to be facing each other in a coaxial way.

The invention relates in particular, but not exclusively, a duplexer for telecommunication systems adapted to receive and to transmit radio frequency signals, and the following description is made referring to this field of application with the only scope of simplifying the exposure.

BACKGROUND ART

As already well known, one of the fundamental elements of a radio telecommunication system, is represented by a device called duplexer, which connects together a transmitter TX, a receiver RX and a unique input/output antenna.

Normally the transmitter TX and the receiver RX of an antenna for high frequency transmissions operate with two different frequencies. These are physically placed next to each other, but they are decoupled by means of the aforesaid duplexer.

Such duplexer comprises essentially a pair of elementary filtering units, mutually specular, which are linked through a particular T-shaped junction placed at their centre. More in particular, an antenna duplexer F for telecommunications comprises an elementary filter Frx for the receiver and an elementary filter Ftx for the transmitter, according to an essentially symmetrical structure.

In this application, each elementary filter is set up by a body provided with a predetermined number of cylindrical cavities, coupled by means of through passing connections called coupling irises. Inside of the cavities of the elementary filters suitable internally sliding discs are placed, in order to tune in frequency each resonant cavity of each filter.

The architecture of the resonant elements, understood as cavity-disc coupling, makes it possible to obtain a particular response in frequency for each elementary filter, and the coupling of two elementary filters at the sides of the T-shaped junction makes it possible to obtain a particular response in frequency for the antenna duplexer.

The response in frequency of an elementary filter, or of the antenna duplexer as a whole, is defined by a predetermined attenuation in passband and by means of a band with a resonance number equal to the number of resonant cavities.

This response in frequency has to present stable characteristics in order to stay within certain realisation specifications. For example, some international specifications have to be respected to guarantee the uniformity of the systems on the market.

But in case of variation of the temperature, the resonant cavities of the filters are subjected to an expansion (of some parts per million) and can in this way change their resonance frequency modifying consequently the response in frequency of each filter. Obviously the useful band of the filters that are used in telecommunication appliances are anyhow maintained within the band imposed by the specifications related to each specific application. This is guaranteed by suitable security margins.

But there is a limit to freedom of choice of these security margins. In particular, it is recommended to consider that outside of the band the filters have to be subject to other specifications, for example inherent to the minimum attenuation, which further influence the final band amplitude to be obtained, which therefore always turns out to be the result of a compromise.

It is therefore particularly important to be able to assign to a resonant structure of the described type a stability in temperature, since, especially in telecommunication applications, the filters are subjected to sensible temperature variations during their functioning. In fact filters are normally mounted in more complex appliances which are quite often used outdoors and therefore subject to variable meteorological conditions due to the installation site and the period of the year.

In order to obtain a good stability in temperature, these filters are usually realised by means of an iron-nickel alloy (with a percentage of nickel of 40%), called INVAR. This alloy has an extremely limited linear factor of thermic expansion, in particular of the range of 3 ppm (parts per million).

Even though satisfactory from the point of view of the invariance of the services in function of the temperature, a filter realised with INVAR is affected by big problems, as this particular alloy is extremely expensive and difficult to process with a consequent increase of machine time necessary to realised each single piece as well as with the wear and tear of the milling-machines and of the tools used during the manufacturing procedure.

The fundamental technical problem of the present invention is that of excogitating a filter for applications in telecommunications with constant performances in case of varying temperature, presenting structural and functional characteristics enabling the limitation of costs, difficulties and manufacturing times.

SUMMARY OF THE INVENTION

The idea of a solution the present invention is based on, is that to use less valuable material than the INVAR alloy, for example steel, to realise the parts setting up each elementary filter, achieving however the wanted characteristics of performance in case of some temperature variations by means of a particular structure for the resonant cavities of the filter.

In particular according to the invention, the disc for the adjustment of the frequency is not directly inserted in the body of the elementary filter through a threaded hole, but it is connected to it by an intermediate bush element. The proposed solution exploits difference of linear thermic expansion of the materials constituting the bush and the internal disc to achieve a self-compensating effect of the resonance frequency in the case of thermic expansion.

Based on this solution idea, the technical problem is solved by a filter of the previously indicated type and characterised in that to the filter at least one bush is associated having one portion engaged in the aforesaid threaded passage hole; inside of the bush is placed the stem of a disc.

BRIEF DESCRIPTION OF THE DRAWINGS

The features of the present invention which are believe to be novel are set forth with particularity in the appended claims. The invention, together with further objects and advantages thereof, may be understood with reference to the following description, taken in conjunction with the accompanying drawings and in which:

DETAILED DESCRIPTION OF A PREFERRED EMBODIMENT OF THE INVENTION

As already previously said with reference to the state of the art paragraph, an antenna duplexer in particular for telecommunication applications comprises a first and a second filtering body. Such first and second elementary filtering bodies may have a symmetrical and specular structure, and for this reason in the description hereafter only one of the two shells setting up the complete duplexer to simplify the exposure.

Figure 1:
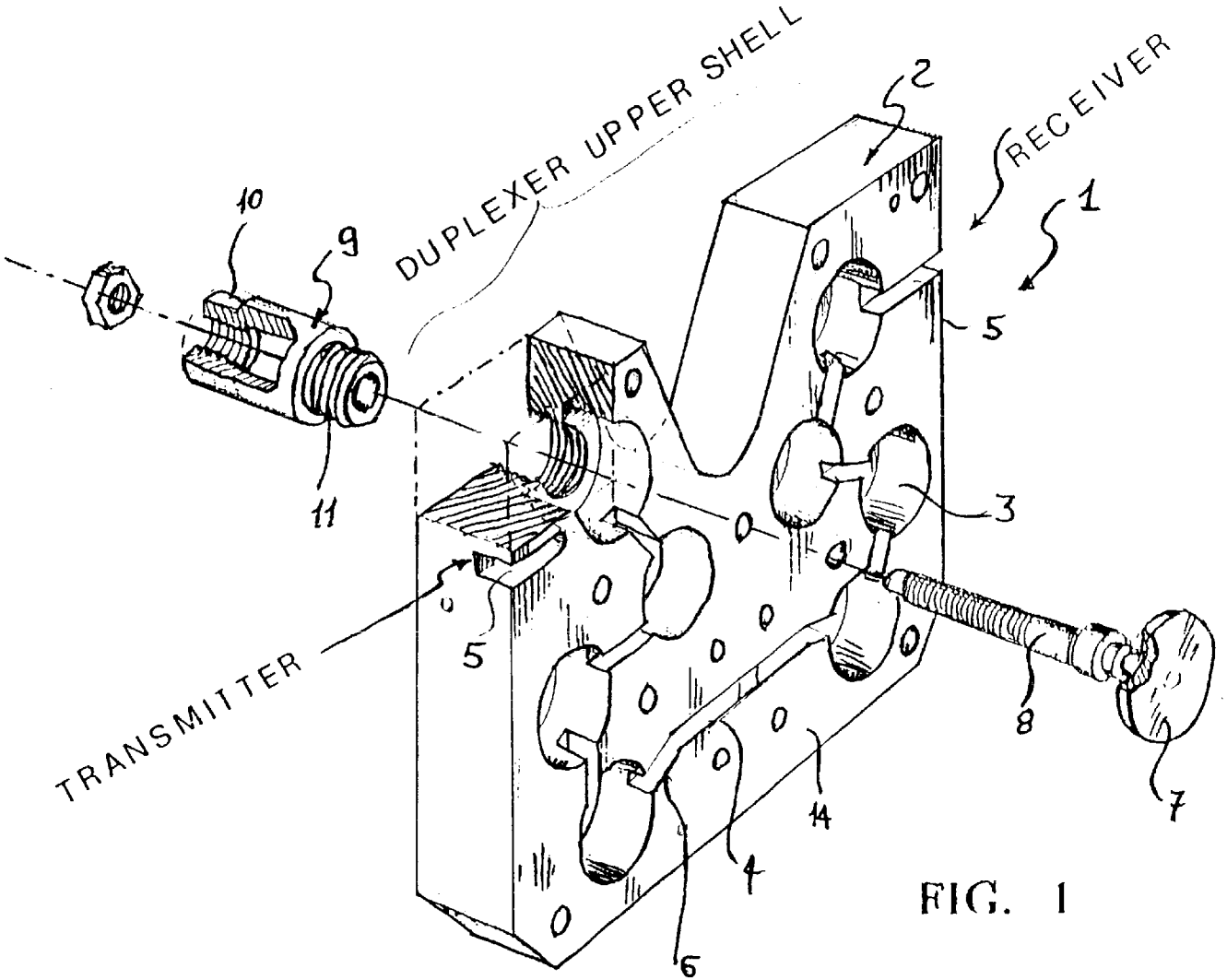
FIG. 1 represents an exploded view in perspective of the upper parts of a duplexer containing two filters realised according to the invention.
Figure 2:
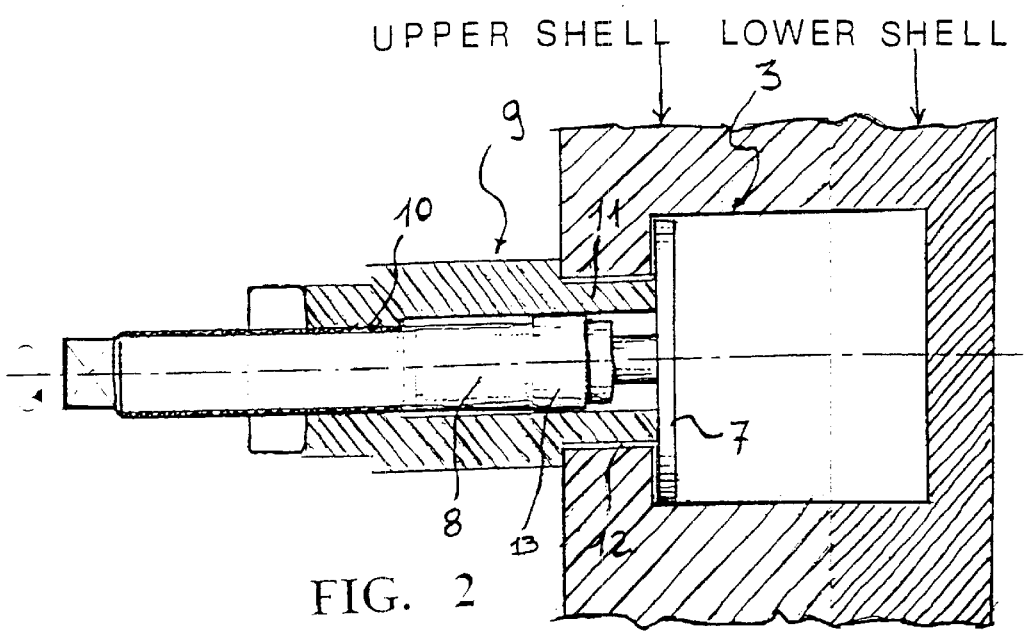
FIG. 2 represents a schematic view in section of a resonance cavity of the elementary filter of FIG. 1, in a first operating condition.
Figure 3:
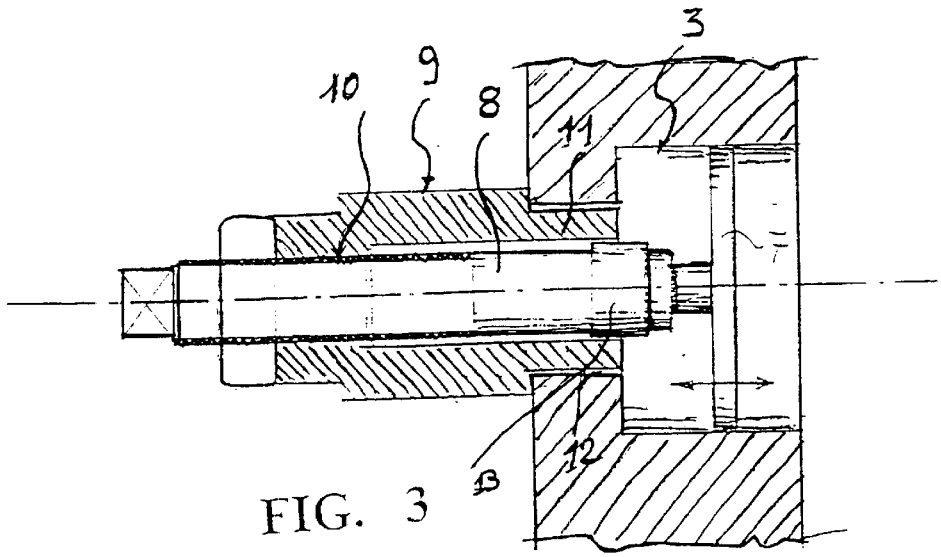
FIG. 3 represents a schematic view in section of a resonance cavity of the elementary filter of FIG. 1, in a second operating condition.

With reference to such figures and in particular to FIG. 1, the upper part of the duplexer realised according to the invention has been indicated as a whole and schematically by the numerical reference 1. Therefore FIG. 1 represents one of the two shells bound together containing the upper part of the two filters.

The upper part 1 of the duplexer is set up by a body 2 with an essentially parallelepiped flattened shape presenting a surface 14 in which a plurality of cavities 3 with an essentially cylindrical shape have been obtained.

The cavities 3 are equal in number and position in upper body and lower one of the duplexer, so that they turn out to be facing each other and coaxial when the first one and the second body are bound together to set up the cylindrical cavities.

The upper body 2 comprises a part from a housing seat 4 for a T-shaped junction, as well as at least a pair of grooves 5, suitable to facilitate the coupling in waveguide between two elementary filters, TX and RX, to realise as previously described a complete antenna duplexer.

Such body 2 includes moreover a plurality of coupling irises 6 necessary for the coupling to the connection between the resonance cavities 3.

As illustrated in FIG. 1, each resonance cavity 3 constitutes the housing seat of an adjustment disc 7. Every disc is provided at one end with a threaded support stem 8 suitable to adjust the position of the disc itself inside the resonance cavity 3.

Advantageously according to the invention, the adjustment disc 7 is not inserted directly in a threaded hole realised on the summit of the resonance cavity 3, as foreseen by the already known art, but is connected to the relative cavity 3 by interposition of a bush 9.

According to the invention at the top of each cavity 3 a threaded passage hole 12 is foreseen. Stem 8 of disc 7 goes through this passage hole 12 without engaging in the screw thread of this latter.

Bush 9 comprises a first 10 and a second threaded portion 11. In particular, the first portion 10 is threaded inside and is adapted to engage with the threaded stem 8 of the adjustment disc 7. The second end portion 11 is externally threaded to match with the threaded hole 12 realised in the top of the resonance cavity 3.

The presence of bush 9 makes it possible to use an adjustment disc 7 with compensation length much longer compared to the already known solutions. Advantageously according to the invention, the second threaded portion 11 of bush 9 enables a safer and guided centring of the disc inside the cavity, cancelling substantially the possibilities that the disc 7 may get in touch with the walls of the cavity itself.

From the same point of view, the threaded stem 8 presents a ring-shaped edge 13 with an external diameter larger than the diameter of the stem itself. In any case, the ring-shaped edge 13 get therefore in touch with bush 9 avoiding in this way the contact between the adjustment disc 7 and the cavity 3.

The axis of the disc, the bush and the cavity coincide therefore opportunely.

By means of the architecture described for disc-bush-cavity it is possible to avoid the use of the alloy INVAR and to realise the duplexer 1 with different and not particularly precious materials. In particular it is possible to achieve a self-compensation in temperature for the described architecture associating different materials, with different values of the thermic linear expansion factor.

The resonance cavity 3, and therefore the upper body 2 of the duplexer 1, are therefore realised with a little precious material, which presents a rather high value of the linear thermic expansion factor.

In the preferred embodiment, steel has been used having a linear thermic expansion factor in the range of 10–14 ppm.

To obtain a compensation of the dimensional variation of the structure, and therefore invariance of the performances, the adjustment disc 7 and the bush 9 are furthermore realised with materials presenting very different linear thermic expansion factors. In the preferred embodiment, the adjustment disc 7 and the stem 8 is made of aluminium which has a linear thermic expansion factor in the range of 23–24 ppm, while the bushes 9 are preferably still realised in INVAR (linear thermic expansion factor equal to 3 ppm). However, the manufacturing of such INVAR bushes turns out to be easily feasible with machine tools of the known type and also relatively little problematic and/or expensive their form being essentially cylindrical.

It is alternatively possible to make the bushes 9 out of steel but increasing their length. In reality, the self-compensation effect is much higher the greater the difference of the thermic expansion factor is between the material used for the realisation of the disc and the bush. The functioning of the complex disc-bush-cavity in presence of thermic expansion is therefore the following.

When the resonance cavity 3 is tuned "for low frequencies" the adjustment disc 7 turns out to be completely extracted. With the increasing of the temperature (arriving, for example, at +70° C.) the resonance cavity 3 expands and its resonance frequency diminishes; stem 8 of adjustment disc 7, thank you to its major working length, manages with its expansion to increase the resonance frequency, bringing it back to the desired value. When the temperature is reduced there will be an analogous mechanism with the result of a contraction of the dimensions and to a corresponding increase of the resonance frequency.

In fact the expansion of the resonance cavity 3 defines the absolute frequency deviation to be compensated: the combination of the materials used for the bush 9 and for the stem 8 of the disc 7 is such to vary the real working length of the stem itself of the adjustment screw.

In fact, the useful working length of the tuning screw actually the difference between the beginning of the inside screw thread of the bush and the surface of disc 7.

In particular, in order to obtain the compensation of the thermic expansions of the different parts setting up each elementary filter, the of adjustment disc 7 and stem 8 must have a linear thermic expansion factor higher than the one of the resonance cavity 3, while bush 9 must have a linear thermic expansion factor smaller than or equal to that of the resonance cavity 3.

Figure 4:
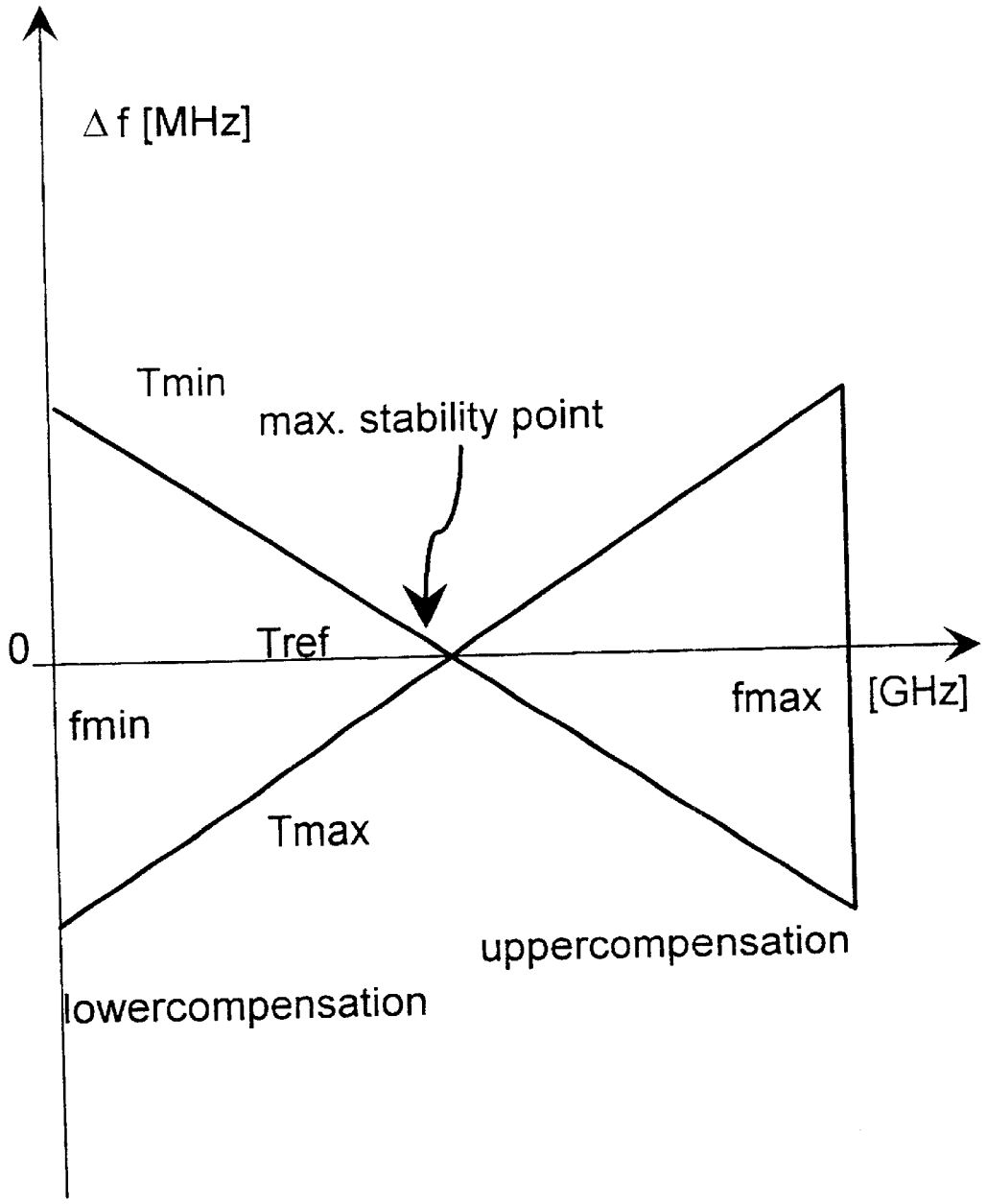
FIG. 4 shows a schematic view of a diagram illustrating the temperature compensation modalities achieved by means of the elementary filter of FIG. 1.

The range of frequencies on which such thermic compensation has to take place coincides with the interval of tunableness of the filter. In the preferred embodiment of the invention an optimum compensation at the central frequency of the tunableness range is carried out, with an undercompensation at the low frequencies (prevails therefore expansion of the resonance cavity 3) and an overcompensation at the high frequencies (prevails the shifting of the adjustment disc 7), as shown in FIG. 4.

In fact at low frequencies, the disc is little introduced (the cavity presents therefore a major height): however the described compensation effect is achieved, but the useful working length is the minimum one. Therefore the frequency deviation is not corrected completely, and a buffer effect is obtained with the prevailing of the natural deviation of the cavity.

If the temperature increases, the resonance cavity 3 expands and the resonance frequency decreases: the expansion of stem 8 of the adjustment disc 7 manages however to newly increase the resonance frequency, even though not completely.

On the contrary at the high frequencies, the disc nearly completely introduced inside the cavity and the working length increases in such a way to overcome the necessary compensation effect.

If the temperature gets up, the resonance cavity 3 expands and the resonance frequency goes down: the expansion of the stem 8 of the adjustment disc 7 in presence of a greater real working length pushes the resonance frequency up to even higher values than those of the environmental temperature.

At the central frequency of the functioning range of the filter, a perfect compensation is achieved thanks to the contrasting expansions of cavity, bush and disc.

It is important to note that the higher the difference is between the linear thermic expansion factors of the bush 9 and of stem 8 of the adjustment disc 7 are, the smaller results to be the necessary length in order to obtain the perfect compensation of each filter.

The particular configuration of the duplexer according to the invention makes it therefore possible to release from the use of structures completely realise in INVAR, thus to achieve a significant reduction of the costs of the duplexer as a whole, besides of elements much simpler to be processed and to be realised.

Although the invention has been described with particular reference to a preferred embodiment, it should be understood that the present invention is not limited thereto, since other embodiments may be made by those skilled in the art without departing from the scope thereof. It is thus contemplated that the present invention encompasses any and all such embodiments covered by the following claims.

What is claimed is:

1. A decoupling filter for high frequency transceivers of the type of self-compensation in temperature realized on a body provided with a plurality of resonance cavities, inside of which a corresponding adjustment disc is lodged in a removable and coaxial way, the latter being provided with a support stem coming out of a passage hole realized at the top of each cavity, said passage hole being threaded, and having at least one brush having a portion engaged in the hole, and inside of said bush the stem of the disc is housed, characterized by the association of different materials with different values of the thermic linear expansion factor of the following elements:

said stem and said disc are realized with a material having a linear thermic expansion factor in the range of 23–24 ppm;

said bush is realized with a material having a linear thermic expansion factor in the range of 3 ppm;

said body is realized with a material having linear thermic expansion factor in the range of 10–14 ppm.

2. The filter according to claim 1, wherein said stem of the disc is realized in aluminum.

3. The filter according to claim 1, wherein said bush is realized in an iron-nickel alloy.

4. The filter according to claim 1, wherein said body is realized in steel.

5. The filter according to claim 1, wherein said threaded stem has a ring-shaped edge.

* * * * *